United States Patent [19]

Jarrett

[11] 4,381,484

[45] Apr. 26, 1983

[54] TRANSISTOR CURRENT SOURCE

[75] Inventor: Robert B. Jarrett, Tempe, Ariz.

[73] Assignee: Motorola, Inc., Schaumburg, Ill.

[21] Appl. No.: 269,117

[22] Filed: Jun. 1, 1981

[51] Int. Cl.[3] ..... G05F 3/08

[52] U.S. Cl. ..... 323/316; 323/315; 330/288

[58] Field of Search ..... 323/273, 311, 312, 315, 323/316; 307/296 R; 330/288

[56] References Cited

U.S. PATENT DOCUMENTS

| | | | |
|---|---|---|---|
| 3,843,933 | 10/1974 | Ahmed | 323/315 |
| 4,008,441 | 2/1977 | Schade | 323/315 |
| 4,260,945 | 4/1981 | Ahmed | 323/316 |
| 4,278,946 | 7/1981 | Kaplan | 330/288 |
| 4,292,584 | 9/1981 | Kusakabe | 323/316 |

FOREIGN PATENT DOCUMENTS

| | | | |
|---|---|---|---|
| 54-125950 | 9/1979 | Japan | 330/288 |

*Primary Examiner*—William H. Beha, Jr.
*Attorney, Agent, or Firm*—Michael D. Bingham

[57] ABSTRACT

A PNP transistor current source for sourcing current to a load connected thereto the magnitude of the sourced current being many times greater than the magnitude of a small constant reference current supplied to the current source. The PNP current source is suitable for being manufactured in monolithic integrated circuit form as the current source is made substantially independent to current amplification factor variations normally associated with typical integrated circuit fabrication processes. The PNP current source comprises a pair of PNP transistors having the respective base and emitters commonly coupled together with the emitter area of the output PNP device being N times greater than the emitter area of the other PNP device and including a feedback loop having a current mirror which is coupled between the collector of the other PNP device and the output of the reference current source, a Darlington amplifier coupled between the output of the reference current source and the commonly connected bases of the two PNP transistors wherein the collector currents of the two PNP transistors are made independent to beta variations of each devices.

17 Claims, 1 Drawing Figure

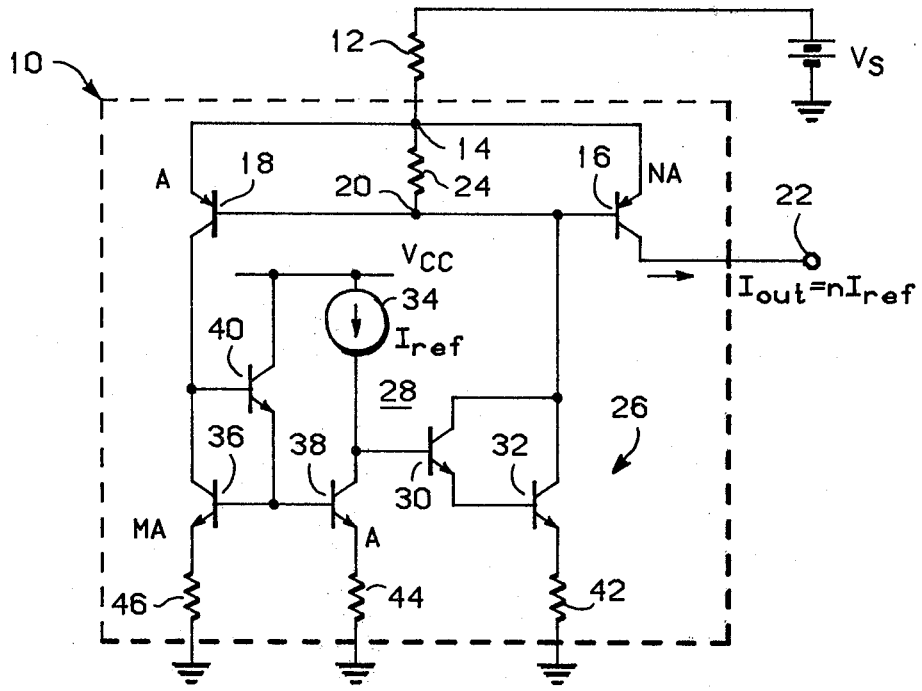
10
12
Vs
14
A
18
20
24
16
NA
22
Vcc
34
Iref
Iout=nIref
40
28
26
36
38
32
30
MA
A
46
44
42

TRANSISTOR CURRENT SOURCE

BACKGROUND OF THE INVENTION

1. Field of the Invention

This invention relates to circuitry for supplying a known current to a load connected thereto and more particularly to an integrated PNP current source circuit for sourcing a relatively large current to a load coupled thereto.

2. Description of the Prior Art

There are many applications for current sources which require sourcing a large current to a load with a minimal amount of power available to the source to derive the large current. For instance, one such application is the contemporary monolithic electronic ignition system which provides spark for operating an automotive engine. Typically, as understood, the integrated electronic ignition system provides 50 milliamps of current or more to a discrete power device which in turn drives an ignition coil to charge the same so as to generate spark to operate the engine. In the past many electronic ignition systems have used a series pass NPN transistor for sourcing current to the power device. For example, U.S. Pat. No. 3,871,347 discloses the use of a series pass NPN transistor device for driving the amplifier stage which is connected to the ignition coil.

A problem that arises with the use of monolithic ignition systems utilizing NPN series pass devices is the need to meet the automobile manufacturer's requirement that these systems survive an intermittent battery condition while the ignition coil is driving a capacitive load. Under these conditions, large negative current transients occur across the primary winding of the ignition coil. Due to parasitic diodes which are always present in monolithic transistor structures large currents are caused to be sourced from the NPN series pass device which can damage or destroy this device. Another problem occurs under load dump specification conditions wherein 80 volts or more can be applied to the solid state ignition system which makes it very difficult to maintain the series pass NPN device in a safe operating quiescent area without sacrificing system performance. An additional problem caused by these large negative current transients is substrate injection of minority carriers into the monolithic substrate which is caused by the epitaxial substrate parasitic diode present at the collector of the NPN series pass transistor. Substrate injection can cause the integrated circuit to adversely perform and if used in the aforementioned ignition system potentially fail U.S. emission standards.

The above described problems may be overcome by utilizing lateral PNP transistors for sourcing the current at the output of the integrated ignition circuit. However, PNP current sources have disadvantages associated therewith. In order to protect the integrated circuit from load dump conditions if used in an ignition system an internal resistor of 200 ohms or greater is generally required along with zener protection as is known. However, the ignition system must also operate as specified by the automobile manufacturers with a minimum of five volts power supply available. This means that with only five volts for operation that 20 milliamps or less is available to the entire ignition system. Hence, the PNP current source must be suitable for leveraging a small current level up to the 50 milliamps or greater current required to be sourced at the output of the ignition system. However, utilizing today's processing capabilities many, if not all, contemporary high current PNP current sources are susceptible to beta current amplification variations whereby the magnitude of the desired output current may vary over 50% with beta values that can vary from 3–20 due to process variations in the devices at high emitter current densities.

To overcome beta variations and to make the monolithic PNP high current source independent to base current variations caused thereby some contemporary designers have resorted to a base current elimination circuit as understood. This, however, normally requires the use of an operational amplifier which in turn can cause oscillation of the PNP current source as well as other stability problems because of the high gain of the amplifier. To overcome these stability problems many prior art monolithic PNP current sources must utilize an external capacitor to create a dominate system pole at a low frequency such that the circuit has adequate unity gain phase margin.

Thus, there is a need for a high current PNP monolithic current source for multiplying a small reference current up to a large output current which is substantially independent to beta variations of the individual PNP transistors arising from process variations and which requires no external capacitors while exhibiting adequate unity gain phase margin to prevent stability problems.

SUMMARY OF THE INVENTION

Accordingly, it is an object of the present invention to provide an improved high current PNP current source.

Another object of the present invention is to provide a high current monolithic PNP current source substantially independent to beta variations caused by contemporary integrated circuit processing techniques.

Still another object of the present invention is to provide an improved high current PNP current source requiring no external capacitors to be utilized for insuring stability of operation thereof.

In accordance with the above and other objects there is provided a high current PNP monolithic integrated current source circuit comprising a pair of PNP transistors having the bases and emitters thereof commonly connected in a parallel configuration with the emitters being coupled to a first terminal at which is supplied a first operating potential and feedback means coupled between the commonly connected bases and the collector of the second one of the pair of transistors such that with the emitter area of the first transistor being N times greater than the emitter area of the second transistor the collector current provided at the collector of the first transistor is caused to be N times greater than the collector current flowing in the second transistor and is substantially independent of the current amplification factor of either of the two transistors.

BRIEF DESCRIPTION OF THE DRAWINGS

The single FIGURE is a schematic diagram of the preferred embodiment of the invention.

DETAILED DESCRIPTION OF THE PREFERRED EMBODIMENT

High current PNP current source 10 which is suitable to be manufactured in integrated circuit form is shown in the single FIGURE within the dashed outline form. PNP current source 10 is adapted to receive an external source of operating potential $V_S$ via resistor 12 which is coupled to terminal 14 of the current source. For example, if current source 10 is to be utilized in an electronic ignition system, potential source $V_S$ would be the automobile battery with potential $V_{CC}$ being derived from an internal voltage regulator circuit that forms part of the ignition system. PNP current source 10 is illustrated as including a pair of PNP transistors 16 and 18 which may be formed laterally within the integrated circuit with the emitters thereof commonly connected to node 14 and the bases commonly connected at node 20. The collector of the first transistor 16 is adapted to be connected to an output terminal 22 of the current source for sourcing a current $I_{OUT}$ thereat. A resistor 24 is connected between nodes 14 and 20 which helps provide stability to the current source. A feedback loop 26 is coupled between the base electrodes of transistors 18 and 16 and the collector of transistor 18 which comprises Darlington configured amplifier 28 including NPN transistors 30 and 32, a source for reference current 34 coupled between $V_{CC}$ and the base of transistor 30 of Darlington amplifier 28. Feedback loop 26 also includes a current mirror circuit comprising transistors 36, 38 and 40 with inputs supplied thereto at the collector of transistor 18 and the output of current source 34. Generally, the connection of transistors 36 and 40 is comparable to a diode means usually forming a portion of a well known current mirror wherein the diode is connected in parallel with the base emitter of an output transistor such as transistor 38. Transistor 40 which has its base connected to the collector of transistor 36 and the emitter thereof connected to the commonly connected base electrodes of transistors 36 and 38 and its collector coupled to $V_{CC}$ operates in a well known manner to suppress base current errors otherwise associated with NPN transistors 36 and 38. The emitters of transistors 32, 36 and 38 are returned via resistors 42, 44, and 46 respectively to a source of ground reference potential.

As aforementioned the object of the present invention is to provide a source of current at output terminal 22 the magnitude of which is solely dependent on the emitter area ratioing of transistor devices 16 and 18 and which is independent to process variations causing the beta current application factor of the lateral PNP transistors to vary from one wafer lot to another. As generally understood if PNP transistors 16 and 18 are formed in like epitaxial tubs and have like geometries and, further, assuming that the rb and re junction resistances are the same, $I_{OUT}$ should have a magnitude which is equal to N times the collector current of transistor 18.

In operation, as PNP current source 10 is powered up, reference current source 34 provides current to render Darlington amplifier 28 conductive with transistors 30 and 32 being in saturated condition initially to sink current from the bases of transistors 16 and 18. Thus, these two transistors are rendered conductive. As transistor 18 becomes conductive, the collector current therefrom renders the current mirror circuit operative wherein transistor 36 causes transistor 38 to become conductive. Initially, if it is assumed for discussion purposes that the emitter areas of transistor 36 and 38 are equal, transistor 38 will attempt to conduct an equal amount of current as is conducted by transistor 36. Hence, as transistor 36 begins to conduct, transistor 38 begins sinking current $I_{ref}$ away from transistor 30. This action will continue until such time that the current mirror circuit is in a balanced condition, i.e., transistor 36 and 38 are both conducting a current equal to $I_{ref}$ regardless of any differences in the forward current amplification factor of PNP transistors 16 and 18. Ideally then, with transistors 16 and 18 being prefectly matched, the collector current sourced from the collector of transistor 16 will be N times $I_{ref}$. Hence, if transistor 18 sources a current of a magnitude of one milliamp to transistor 36 and if the value of N is equal to 50, for instance, output current $I_{OUT}$ will be equal to 50 milliamps substantially independent of the betas of the transistors due to the feedback loop operating to force the current mirror to be in a balanced state.

As illustrated, the emitter area of transistor 36 is equal to M times the emitter area of transistor 38 such that for the current mirror to be balanced transistor 36 must conduct a current which is equal to M times the magnitude of the current conducted by transistor 38. As an example, if M is equal to 10, current source 34 must supply a current equal to 100 microamps to produce a current of one milliamp to flow in the collectors of transistors 36 and 18 which, if N equals 50, produces a current of 50 milliamps at output terminal 22. A current source capable of supplying 100 microamps is fairly easy to provide even with minimal operating potential.

Thus, what has been described above is a high current PNP current source which requires a source of minimal reference current to provide an output current many times greater than the reference current at an output. This output current is substantially independent to beta variations in the PNP transistor devices forming the current source.

In addition, PNP current source 10 provides closed loop regulation with a minimum of 30 degrees of unity gain phase margin without requiring external capacitors. It can be shown that the dominant pole for the curcuit is due to the inherent expitaxial substrate capacitor formed at the collector of transistor 38. However, by making resistor 42 of sufficient magnitude, for example, equal to 100 ohms, the RC time constant formed thereby between the inherent capacitor and the beta multiplied value of resistor 42 produces a pole in the kiloHertz frequency range with all other system poles, such as those due to the inherent parasitic epicapacitor formed at the bases of transistors 16 and 18 being at 2 megaHertz or higher. However, at the frequency at which the dominant pole occurs the gain of the system is less than 100 typically and rolls off thereafter. Hence, at the higher order or secondary poles the gain of constant current source 10 is less than unity such that oscillations are inhibited.

I claim:

1. A current source, comprising:

a pair of transistors each having an emitter, a collector and a base, the base and emitter of each of said pair of transistors being commonly coupled to each other respectively and coupled to a first terminal at which is supplied a first operating potential, said collector of the first one of said transistors being coupled to an output of the current source, said emitter of said first transistor having an area N times greater than the area of said emitter of said second transistor;

amplifying circuit means having an output coupled to said bases of said pair of transistors and an input including an input and an output transistor coupled respectively to said input and output of said amplifying circuit means and resistive means coupled between said output transistor and a second terminal at which is supplied a ground reference potential such that a system, low frequency dominant pole is formed at said input of said amplifying means;

current source means for supplying a constant reference current at an output, said output being coupled to said input of said amplifying means;

current mirror means having first and second inputs coupled respectively to said collector to said second transistor and said current source means; and said current mirror means and said amplifying means providing a feedback loop for causing the current sourced from said collector of said first transistor to be N times greater than the current sourced from said collector of said second transistor substantially independent of the beta amplification factor of said first and second transistors.

2. The current source of claim 1 wherein said input and output transistor form a Darlington amplifier.

3. The current source of claim 2 wherein said current mirror means includes:

diode means coupled between said collector of said second transistor and a second terminal at which is supplied a reference potential; and a third transistor having an emitter, collector and base, said emitter being coupled to said second terminal, said base being coupled to said diode means and said collector being coupled to said current source means.

4. The current source of claim 3 wherein said diode means conducts a current M times greater than the current conducted by said third transistor when said current mirror means is in a balanced condition.

5. The current source of claim 2 wherein said current mirror means includes:

a third transistor having an emitter, collector and base, said emitter being coupled to a second terminal at which is supplied a reference potential, said collector being connected to said current source means;

a fourth transistor having an emitter, collector and base, said emitter being coupled to said second terminal, said base bein connected to said base of said third transistor, and said collector being coupled to said collector of said second transistor; and a fifth transistor having an emitter, collector and base, said emitter being coupled to said commonly connected bases of said third and fourth transistors, said base being coupled to the collector of said fourth transistor and said collector being maintained at a constant potential.

6. The current source of claim 5 wherein the emitter area of said fourth transistor being M times greater than the emitter area of said third transistor.

7. The current source of claim 4 or 6 wherein said collector current flowing through said first transistor is caused to be MN times the magnitude of said constant reference current sourced from said current source means.

8. The current source of claim 7 wherein:

said first and second transistors being PNP transistors; and said third, fourth and fifth transistors being NPN transistors.

9. A current source for sourcing a current to a load connected thereto, comprising:

a first transistor of first conductivity type having an emitter, base and collector, said collector being coupled to an output of the current source, said emitter being coupled to a first terminal at which is supplied a first source of operating potential;

a second transistor of said first conductivity type having an emitter, base and collector, said base being coupled to said base of said first transistor, said emitter being coupled to said emitter of said first transistor, the emitter area of said first transistor being N times greater than the emitter area of said second transistors;

feedback means coupled between said bases of said first and second transistors and said collector of said second transistor for causing said collector current of said first transistor to be N times the magnitude of the collector current flowing from said second transistor and which is substantially independent to variations of the current amplification factor of said first and second transistors; and said feedback means including reference current source means for supplying a constant reference current at an output thereof;

current mirror means coupled between said collector of said second transistor and said output of said reference current source; and amplifier means coupled between said base of said first transistor and said output of said reference current source means including an output transistor and a resistor coupled between said base of said first transistor and a terminal at which is supplied ground reference potential wherein the closed loop gain of said amplifier means is restricted.

10. The current source of claim 9 wherein said amplifier means includes a Darlington amplifier.

11. The current source of claim 9 or 10 wherein said current mirror means includes:

diode means coupled between said collector of said second transistor and a second terminal which is supplied a ground reference potential; and a third transistor of second conductivity type having an emitter, base and collector, said emitter being coupled to said second terminal, said base being coupled to said diode means, and said collector being coupled to said output of said reference current source means.

12. The current source of claim 11 wherein said diode means includes:

a fourth transistor of said second conductivity type having an emitter, collector and base, said emitter being coupled to said second terminal, said base being coupled to said base of said third transistor, and said collector being coupled to said collector of said second transistor; and a fifth transistor of said second conductivity type having an emitter, collector and base, said emitter being coupled to said base of said fourth transistor, said base being coupled to said collector of said fourth transistor, and said collector being maintained at a constant potential, the emitter area of said fourth transistor being M times greater than the emitter area of said third transistor.

13. The current source of claim 12 wherein said amplifier means comprising a Darlington amplifier including:

a sixth transistor of said second conductivity type having an emitter, collector, and base, said base being connected to the collector of said third transistor, said collector being coupled to the base of said first transistor; and a seventh transistor of said second conductivity type having an emitter, a base, and collector, said emitter being coupled to said second terminal, said base being coupled to said emitter of said sixth transistor, and said collector being coupled to said collector of said sixth transistor.

14. The current source of claim 13 wherein:

said first and second transistor being PNP transistors; and said transistors of said second conductivity type being NPN transistors.

15. A monolithic integrated current source, comprising:

a first transistor of first conductivity type having an emitter, collector and base, said emitter being coupled to a first terminal for receiving a first source of operating potential, said base being coupled to said first terminal, said collector being coupled to an output of the current source;

a second transistor of said first conductivity type having an emitter, collector and base, said emitter being coupled to said first terminal, said base being coupled to said base of said first transistor;

reference current source means for supplying a substantially contant reference current at an output thereof;

amplifier means coupled between said output of said current reference source means and said base electrode of said first transistor;

current mirror means coupled between said output of said current reference source means and said collector of said second transistor; and said amplifier means including a third transistor of a second conductivity type having an emitter, collector and base, said base being coupled to said output of said reference current source means, said collector being coupled to said base of said first transistor, a fourth transistor of said second conductivity type having an emitter, collector, and base, said base being coupled to said emitter of said third transistor, said collector being coupled to said collector of said third transistor, and a first resistor coupled between said emitter of said fourth transistor and a second terminal at which is supplied a reference potential.

16. The current source of claim 15 wherein said current mirror means includes:

a fifth transistor of said second conductivity having an emitter, a base and collector, said collector being coupled to said output of said current reference source means, said emitter being coupled to said second terminal;

a sixth transistor of said second conductivity type having an emitter, collector and base, said emitter being coupled to said second terminal, said base being coupled to said base of said first NPN transistor, and said collector being coupled to said collector of said second PNP transistor, said emitter area of said second NPN transistor being M times greater than the emitter area of said first NPN transistor; and a seventh transistor of said second conductivity type having an emitter, a collector and a base, said emitter being coupled to said base of said fifth transistor, said base being coupled to said collector of said second NPN transistor, and said collector being maintained at a constant potential.

17. The current source of claim 16 including:

a second resistor coupled between the base and emitter of said first transistor; and the current sourced from the current source being substantially equal to a value MN times the magnitude of said reference current wherein M and N are predetermined constants equal to the emitter area ratios of said fifth and sixth transistors and said first and second transistors respectively.

* * * * *

UNITED STATES PATENT AND TRADEMARK OFFICE

CERTIFICATE OF CORRECTION

PATENT NO. : 4,381,484

DATED : April 26, 1983

INVENTOR(S) : Robert B. Jarrett

It is certified that error appears in the above-identified patent and that said Letters Patent are hereby corrected as shown below:

Column 5, claim 5, line 10, change "bein" to --being--.

Signed and Sealed this

*Twenty-third* Day of *August 1983*

[SEAL]

*Attest:*

GERALD J. MOSSINGHOFF

*Attesting Officer*

*Commissioner of Patents and Trademarks*